United States Patent [19]

Hasebe et al.

[11] Patent Number: 4,693,220

[45] Date of Patent: Sep. 15, 1987

[54] IDLING SPEED CONTROL SYSTEM FOR INTERNAL COMBUSTION ENGINES

[75] Inventors: Hiroshi Hasebe, Hatogaya; Masahiko Asakura, Tokorozawa; Michio Sakaino, Fujimi; Yukio Miyashita, Hannou, all of Japan

[73] Assignee: Honda Giken Kogyo K.K., Tokyo, Japan

[21] Appl. No.: 880,788

[22] Filed: Jul. 1, 1986

[30] Foreign Application Priority Data

Jul. 5, 1985 [JP] Japan ..... 60-146610

[51] Int. Cl.[4] ..... F02M 3/07

[52] U.S. Cl. ..... 123/339; 123/360

[58] Field of Search ..... 123/339, 360, 361, 585

[56] References Cited

U.S. PATENT DOCUMENTS

| | | | |
|---|---|---|---|
| 4,391,245 | 7/1983 | Larson | 123/339 |
| 4,508,076 | 4/1985 | Oda et al. | 123/339 |
| 4,570,592 | 2/1986 | Otobe | 123/339 |

FOREIGN PATENT DOCUMENTS

| | | |
|---|---|---|
| 155255 | 9/1983 | Japan . |
| 155547 | 9/1984 | Japan . |

*Primary Examiner*—Tony M. Argenbright

*Attorney, Agent, or Firm*—Arthur L. Lessler

[57] ABSTRACT

A vacuum-operated actuator controls opening and closing of a throttle valve in an intake passage of an internal combustion engine in response to pressure in a vacuum chamber thereof. A change-over control valve supplies the vacuum chamber, selectively, with first and second control pressures for opening and closing the throttle valve, respectively. An electronic control unit controls the engine idling rotational speed by generating an on-off control pulse signal having a period corresponding to the engine rotational speed, and supplying the change-over control valve with the on-off control pulse signal to cause same to supply the vacuum chamber with the first or second control pressure. The electronic control unit determines the engine rotational speed and a rate of decrease in the engine rotational speed, and halts the idling speed control for a predetermined period of time when the determined engine rotational speed falls within a predetermined range and at the same time the determined rate of decrease falls within a predetermined range. A valve opening-correcting device corrects the throttle valve opening to a larger opening in response to at least one predetermined external load applied on the engine. The electronic control unit actuates the valve opening-correcting device to increase the throttle valve opening which is determined by the change-over control valve in response to the on-off control pulse signal.

3 Claims, 8 Drawing Figures

| Ne≦850rpm | | 1000rpm≧Ne>850rpm | | 1250rpm≧Ne>1000rpm | |
|---|---|---|---|---|---|
| −ΔNe rpm | ONESHOT TIMEmsec | −ΔNe rpm | ONESHOT TIMEmsec | −ΔNe rpm | ONESHOT TIMEmsec |
| 25 | 0 | 15 | 0 | 12 | 0 |
| | 30 | | 100 | | 200 |
| 28 | | 20 | | 16 | |
| | 60 | | 150 | | 250 |
| 31 | | 25 | | 20 | |
| | 100 | | 200 | | 300 |
| 35 | | 33 | | 25 | |
| | 150 | | 250 | | 350 |

IDLING SPEED CONTROL SYSTEM FOR INTERNAL COMBUSTION ENGINES

BACKGROUND OF THE INVENTION

This invention relates to an idling speed control system for internal combustion engines, and more particularly to a system of this kind which is capable of stabilizing the rotational speed of the engine at idle by controlling the quantity of intake air supplied to the engine.

An internal combustion engine for automotive vehicles is so constructed that the output power and rotational speed thereof are controlled by controlling the quantity of intake air by the use of a throttle valve. In an engine having a carburetor, a throttle valve is generally mounted in the carburetor and so arranged that the opening thereof can be adjusted by an idling opening adjusting bolt screwed in the body of the carburetor. The idling opening of the throttle valve is adjusted, by the use of the idling opening adjusting bolt, to a suitable value at the time of manufacture or maintenance operation of the engine, and therefore the idling opening thus set by the bolt cannot be arbitrarily further adjusted by a driver during operation of the engine.

Since the idling opening of the throttle valve thus has an adjusted fixed value, the rotational speed of the engine is kept constant, if the load on the engine does not vary during idling operation of the engine. However, if the load on the engine varies due to variations in the load on the generator for charging the battery or in the load on the automatic transmission, or due to switching-on and -off of the compressor in the air-conditioner, the rotational speed of the engine correspondingly varies, which makes it difficult to obtain stable idling speed and sometimes results in engine stalling. It is therefore necessary to set a desired idling speed at such a high value as to keep the engine always operating in a stable idling condition, without being influenced by the variations in the engine load. However, if the desired idling speed is set at such a high value, there can occur problems such as occurrence of large noise during idling operation of the engine, and increase of the fuel consumption.

Further, as shown in FIG. 6, at so-called snap deceleration, e.g. if the accelerating pedal is stepped on to abruptly increase the engine rotational speed to 1500 rpm when the engine is operating at an idling speed, e.g. 750 rpm and then the accelerator pedal is suddenly released from its stepped-on state, the engine rotational speed can suddenly drop below the desired idling speed, which render the engine operation unstable and sometimes causes engine stalling.

To solve such problems, it has conventionally been proposed e.g. by Japanese Provisional Patent Publication No. 58-155255 to control the throttle valve opening during idling operation of the engine by the use of a pulse motor. Another method of controlling the idling speed of the engine has been proposed by Japanese Provisional Patent Publication No. 59-155547, which comprises detecting the rotational speed of the engine by the use of a predetermined crank angle signal, calculating the difference between the detected engine rotational speed and a desired idling speed, and controlling the quantity of intake air bypassing the throttle valve by controlling the duty ratio of a control valve with a control signal corresponding to the difference thus calculated, so as to attain the desired idling speed.

The above proposed methods, however, require complicated control systems as well as expensive control devices and control valves, and thereby are not practical.

SUMMARY OF THE INVENTION

It is an object of the invention to provide an idling speed control system which is simple in construction and can be manufactured at a low cost.

It is a further object of the invention to mitigate the rate of decrease of the engine rotational speed at snap deceleration to thereby prevent unstable engine operation and engine stalling.

It is a further object of the invention to assure stable engine operation without a drop in the idling speed of the engine when an external load is applied on the engine at idle, to thereby improve the driveability.

It is a further object of the invention to correct the idling speed of the engine through multiple stages using different correction amounts dependent upon the magnitudes of external loads applied on the engine.

According to the invention, the foregoing object is attained by providing an idling speed control system for controlling idling rotational speed of an internal combustion engine having an intake passage and a throttle valve arranged therein, comprising: vacuum-operated actuator means having a vacuum chamber, and a diaphragm defining the vacuum chamber and operatively connected to the throttle valve for controlling opening and closing thereof in response to pressure in the vacuum chamber; change-over control valve means operatively connected to the vacuum-operated actuator means for supplying the vacuum chamber, selectively, with a first control pressure for opening the throttle valve and a second control pressure for closing the throttle valve; electronic control means operatively connected to the engine and the change-over control valve means, the electronic control means being adapted to effect control of the idling rotational speed of the engine by generating an on-off control pulse signal having a period corresponding to rotational speed of the engine, one of on-period and off-period of the on-off control pulse signal having a predetermined constant value, supplying the change-over control valve means with the on-off control pulse signal, in response to which the change-over control valve means supplies the vacuum chamber of the vacuum-operated actuator means, selectively, with the first control pressure and the second control pressure, the electronic control means being adapted to determine the rotational speed of the engine and a rate of decrease in the rotational speed of the engine, and halt the control for a predetermined period of time when the determined rotational speed of the engine falls within a predetermined range and at the same time the determined rate of decrease in the engine rotational speed falls within a predetermined range; valve opening-correcting means operatively connected to the throttle valve and being responsive to at least one predetermined external load applied on the engine for correcting to a larger opening the opening of the throttle valve which is determined by the change-over control valve means in response to the on-off control pulse signal; and the electronic control means being adapted to actuate the valve opening-correcting means to increase the opening of the throttle valve which is determined by the change-over control valve means in response to the on-off control pulse signal, when the electronic control unit halts the control of the idling rotational speed of the engine for the predetermined period of time.

Preferably, the electronic control means is adapted to actuate the valve opening-correcting means to increase the opening of the throttle valve which is determined by the change-over control valve means in response to the on-off control pulse signal for a predetermined constant perid of time.

Also preferably, the electronic control means is adapted to execute the halting of the control when the rotational speed of the engine has dropped across each of a plurality of predetermined values, and at the same time the rate of decrease in the engine rotational speed falls within a predetermined range corresponding to the each of the plurality of predetermined values across which the engine rotational speed has dropped, and to actuate the valve opening-correcting means to increase the opening of the throttle valve which is determined by the change-over control valve means in response to the on-off control pulse signal only when the engine rotational speed has dropped across predetermined one of the plurality of predetermined values.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
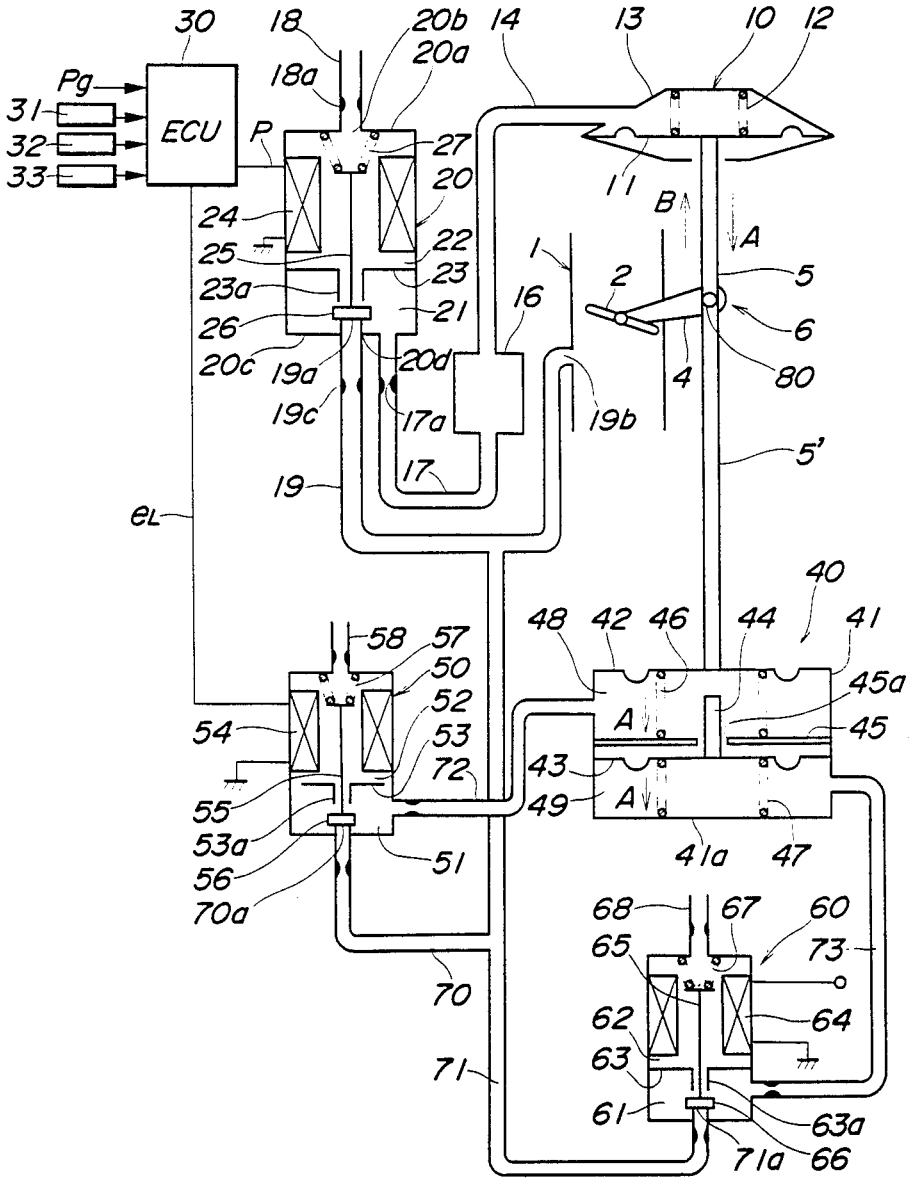
FIG. 1 is a schematic view illustrating the whole arrangement of an idling speed control system for internal combustion engines according to an embodiment of the invention.

Referring now to FIG. 1, there is illustrated the whole arrangement of an idling speed control system according to the invention. Reference numeral 1 designates an intake pipe, one end of which is connected to intake ports, not shown, of the engine, and the other end of which is connected to the atmosphere via an air cleaner, not shown. Arranged in the intake pipe 1 is a throttle valve 2 which is connected to a vacuum-operated actuator 10 by way of a link mechanism 6 comprising a lever 4 and a rod 5, and the opening of the throttle valve 2 is adjusted by the actuator 10 so that the engine rotational speed approaches a desired idling speed when the engine is operating in an idling condition.

The vacuum-operated actuator 10 is a push type which comprises a diaphragm 11, a vacuum chamber 13, and a coil spring 12. The vacuum chamber 13 communicates with a change-over control valve (hereinafter simply called "the solenoid valve") 20 comprising e.g. a frequency solenoid valve, through a surging tank 16 for suppressing fluctuations in pressure and a passage 17. On the other hand, the diaphragm 11 is connected to the rod 5.

The solenoid valve 20 is an on-off type, of which a solenoid 24 is energized or deenergized in response to a control signal from an electronic control unit (hereinafter simply called "the ECU") 30. When the solenoid 24 is energized, a vacuum or negative pressure produced in the intake pipe 1 is introduced into the vacuum chamber 13 in the actuator 10, and when the solenoid 24 is deenergized, the atmospheric pressure is introduced into the vacuum chamber 13.

To be specific, the solenoid valve 20 has two chambers 21 and 22 separated by a partition wall 23 and communicating with each other through a communication port 23*a* provided centrally of the partition wall 23. The chamber 22 also communicates with the atmosphere by way of a passage 18 connected to a hole 20*d* formed in an end wall 20*a* of the chamber 22. One end 19*a* of a passage 19 is hermetically inserted into a hole 20*d* formed in an end wall 20*c* of the chamber 21 centrally thereof. The open end 19*a* of the passage 19 projects into the chamber 21 and is opposed to the communication port 23*a* in the partition wall 23 with a predetermined gap, and the other open end 19*b* communicates with the intake pipe 1 at a predetermined location downstream of the throttle valve 2.

A plunger 25 axially movably extends through the solenoid 24 which is accommodated within the chamber 22 in the solenoid valve 20, with one end thereof slidably projected into the chamber 21 through the communication port 23*a*. A valve body 26 is secured to a face of the projected end of the plunger 25, and arranged between the communication port 23*a* and the open end 19*a* of the passageway 19 such that it selectively closes the opposed open end of the communication port 23*a* or the open end 19*a* of the passage 19 in response to movement of the plunger 25. A return spring 27 is interposed in a contracted state between the other end of the plunger 25 and the opposed end wall 20*a* of the solenoid 20 such that it urges the plunger 25 in the direction in which the plunger projects into the chamber 21. The valve body 26 is urged against the open end 19*a* of the passage 19 by the return spring 27 when the solenoid 24 is deenergized, thereby closing the passage 19. The solenoid valve 24 has one connection terminal electrically connected to the ECU 30, and the other connection terminal grounded.

Incidentally, the passages 17, 18, and 19 communicating with the solenoid valve 20 are provided therein respectively with restrictions 17*a*, 18*a*, and 19*c* at predetermined locations thereof for restricting fluctuations in pressure within respective passages which are to be introduced into the chambers 21, 22 of the solenoid 20.

Reference numeral 40 designates a vacuum-operated actuator comprising, for instance, a two-stage type diaphragm device which has a cylindrical casing 41 with an open end and a closed opposite end having a bottom 41*a*. Diaphragms 42 and 43 are provided across the casing 41, the former at the open end and the latter halfway between the open end and the closed end, respectively. Secured across the casing 41 at a predetermined location between these diaphragms 42 and 43 and closer to the latter is a fixed wall 45 with a through hole 45*a* formed therein at the center thereof. The diaphragms 42, 43 and the fixed wall 45 cooperate to define, within the case 41, a first vacuum chamber 48 between the two diaphragms 42 and 43, and a second vacuum chamber 49 between the diaphragm 43 and the casing bottom 41*a* respectively. The fixed wall 45 is located close to the diaphragm 43 so as to prevent the diaphragm 43 from being displaced toward the first vacuum chamber 48 through a large distance, i.e. beyond the fixed wall 45 when a negative pressure is applied to the first vacuum chamber 48. A movable stopper 44 is secured at its one end to a central portion of the diaphragm 43, and extends through the hole 45*a* for free movement therethrough, and the other end of the movable stopper 44 is opposed to the inner side surface of the diaphragm 42 with a gap therebetween. A diaphragm spring 46 is interposed in a contracted state between the diaphragm 42 and the fixed wall 45, and similarly a diaphragm spring 47 between the diaphragm 43 and the bottom 41*a* of the case 41. An extended portion 5' of the rod 5 has its one end connected to the lever 4 via a pin 80 in such a manner that the lever 4 can rotate about the pin 80, and has the other end secured to a central portion of the outer side surface of the diaphragm 42. Thus, the portion 5' forms an element of the link mechanism 6.

The first and second vacuum chambers 48, 49 of the vacuum-operated actuator 40 are in communication, respectively, with solenoid valves 50, 60, which will be described hereinafter. The actuator 40 and the solenoid valves 50, 60 form valve opening-correcting means having functions described hereinafter.

Like the solenoid valve 20, the solenoid valve 50 is an on-off type electromagnetic valve, and has two chambers 51 and 52 separated by a partition wall 53 and communicating with each other via a communication port 53*a* formed at the center of the partition wall 53. The chamber 52 also communicates with the atmosphere by way of a passage 58 connected to a hole formed in an end wall of the chamber 52. One end 70*a* of a passage 70 hermetically penetrates through a hole formed in the other end wall of the chamber 51 centrally thereof. The open end 70*a* of the passage 70 projects into the chamber 51 and is opposed to the communication port 53*a* on the partition wall 53 with a predetermined gap therethrough, and the other open end of the passage 70 communicates with a passage 71 which in turn communicates with the passage 19. The chamber 51 communicates with the first vacuum chamber 48 of the vacuum-operated actuator 40 via a passage 72.

A plunger 55 axially movably extends through a solenoid 54 which is accommodated within the chamber 52 in the solenoid valve 50, with one end thereof projected into the chamber 51 through the communication port 53*a*. A valve body 56 is secured to the projected end of the plunger 55, and interposed between the communication port 53*a* and the open end 70*a* of the passage 70 such that it selectively closes the opposed open end of the communication port 53*a* or the open end 70*a* of the passage 70 in response to movement of the plunger 55. A return spring 57 is interposed in a contracted state between the other end of the plunger 55 and the opposed end wall of the solenoid valve 50 such that it urges the plunger 55 in the direction in which the plunger projects into the chamber 51. The valve body 56 is urged against the open end 70*a* of the passage 70 by the return spring 57 when the solenoid 54 is deenergized, thereby closing the passage 70. The solenoid 54 has one connection terminal electrically connected to the ECU 30, and the other connection terminal grounded.

Like the solenoid valve 20, the solenoid valve 60 is also an on-off type electromagnetic valve, and has two chambers 61 and 62 separated by a partition wall 63 and communicating with each other via a communication port 63*a* formed at the center of the partition wall 63. The chamber 62 also communicates with the atmosphere by way of a passage 68 connected to a hole formed in an end wall of the chamber 62. One end 71*a* of a passage 71 hermetically penetrates through a hole formed in the other end wall of the chamber 61 centrally thereof. The open end 71*a* of the passage 71 projects into the chamber 61 and is opposed to the communication port 63*a* on the partition wall 63 with a predetermined gap therebetween, and the other open end of the passage 71 communicates with the passage 19. The chamber 61 communicates with the second vacuum chamber 49 of the vacuum-operated actuator 40 via a passage 73.

A plunger 65 axially movably extends through a solenoid 64 which is accommodated within the chamber 62 in the solenoid valve 60, with one end thereof projected into the chamber 61 through the communication port 63*a*. A valve body 66 is secured to the projected end of the plunger 55, and interposed between the communication port 63*a* and the open end 71*a* of the passage 71 such that it selectively closes the opposed open end of the communication port 63*a* or the open end 71*a* of the passage 71 in response to movement of the plunger 65. A return spring 67 is interposed in a contracted state between the other end of the plunger 65 and the opposed end wall of the solenoid valve 60 such that it urges the plunger 65 in the direction in which the plunger projects into the chamber 61. The valve body 66 is urged against the open end 71*a* of the passage 71 by the return spring 67 when the solenoid 64 is deenergized, thereby closing the passage 71. The solenoid 64 has one connection terminal electrically connected to a control circuit (not shown) which is arranged to energize the solenoid 64 only when a compressor of an air-conditioner (not shown) is operating, and the other connection terminal grounded.

Figure 2:
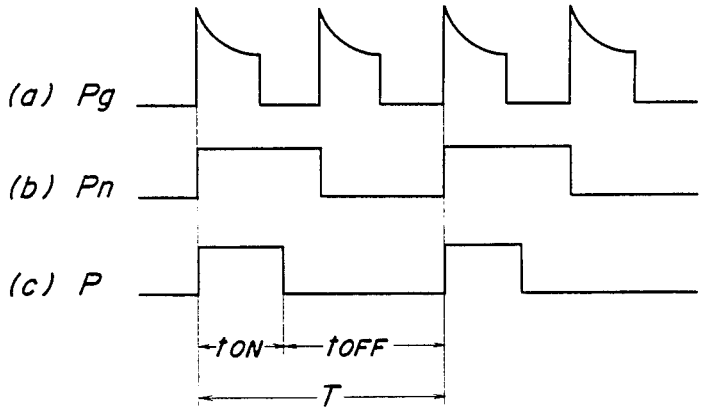
FIGS. 2(*a–c*) show a graph showing waveforms of a pulse signal P generated from an electronic control unit appearing in FIG. 1 on the basis of the period of a control pulse signal Pg for on-off control of a solenoid valve of the idling speed control system, as well as corresponding processed pulses.

Further supplied to the ECU 30 is a signal generated in synchronism with the engine rotation, e.g. an ignition pulse signal Pg [(a) of FIG. 2] from the primary winding in the ignition coil.

The ECU 30 produces an on-off control pulse signal P for on-off controlling the solenoid valve 20 on the basis of the ignition pulse signal Pg inputted thereto and supplies same to the solenoid valve 24.

Reference is now made to the operation of the idling speed control system constructed as above.

When the solenoid 24 is deenergized by the control pulse signal P supplied from the ECU 30, the plunger 25 is biased toward the open end 19*a* by the urging force of the spring 27 so that the valve body 26 closes the open end 19*a* and opens the communication port 23*a*, whereby the atmosphere is introduced into the vacuum chamber 13 in the vacuum-operated actuator 10. Consequently, the diaphragm 11 of the actuator 10 is displaced in the direction of the arrow A in FIG. 1, by the urging force of the coil spring 12. On the other hand, when the solenoid 24 is energized by the control signal P, the plunger 25 is attracted by a magnetic force produced by the solenoid 24 and overcoming the urging force of the spring 27, to close the communication port 23*a* and open the open end 19*a* of the passage 19, whereby negative pressure developed in the intake pipe 1 is introduced into the vacuum chamber 13. As a result, the diaphragm 11 arranged in the vacuum-operated actuator 10 is displaced in the direction of the arrow B, that is, in the opposite direction to that in which the diaphragm 11 is displaced when the solenoid 24 is deenergized.

In this way, the opening of the throttle valve 2 is selectively controlled to a larger degree or to a smaller degree by controlling the duty ratio of the solenoid 24 of the solenoid valve 20 by the use of the control signal P supplied from the ECU 30.

Reference is now made to how the control signal P is generated from the ECU 30.

The ECU 30 is supplied with a signal generated in synchronism with the engine rotation, e.g. the ignition pulse signal Pg from the primary winding of the ignition coil [(a) of FIG. 2]. The ignition pulse signal Pg has its frequency divided by a predetermined number N, e.g. two, to obtain a pulse signal Pn [(b) of FIG. 2]. Then, the ECU 30 generates the control pulse signal P [(c) of FIG. 2] which is at a high level for a predetermined fixed time period tON from the leading edge of each pulse of the pulse signal Pn.

The pulse repetition period T of the control pulse signal P is equal to that of the pulse signal Pn, wherein the solenoid 24 is energized for the predetermined fixed time period tON and then deenergized for a time period tOFF (=T−tON). Therefore, the duty ratio of the solenoid valve 20 varies in response to the engine rotational speed Ne. To be specific, as described above, the on-period or pulse duration tON of the control pulse signal P [(c) of FIG. 2] is set at a predetermined constant value, and the off-period tOFF becomes longer as the engine rotational speed Ne decreases, and vice versa.

Consequently, as the engine rotational speed Ne decreases, the opening period of the communication port 23*a* in the solenoid 20 which communicates with the atmosphere becomes longer, in response to which the negative pressure in the vacuum chamber 13 becomes smaller, so that the diaphragm 11 is displaced by the urging force of the spring 12 to move the rod 5 along the arrow A and thereby open the throttle valve 2. Then, the engine rotational speed Ne increases according to the longer opening action of the throttle valve 2. On the other hand, as the engine rotational speed Ne increases, the opening period of the communication port 23*a* in the solenoid valve 20 becomes shorter, and then the negative pressure PB in the intake pipe becomes higher. As a result, a high negative pressure is introduced into the vacuum chamber 13 of the vacuum-operated actuator 10 and accordingly the negative pressure therein becomes larger, so that the diaphragm 11 is attracted by the higher negative pressure in the vacuum chamber 13 against the urging force in the spring 12 to pull the rod 5 back along the arrow B and thereby close the throttle valve 2. Then, the engine rotational speed decreases according to the closing action of the throttle valve 2.

As described above, when the engine rotational speed Ne at engine idle is high, the ratio of the on-period (constant value) tON of the control pulse signal P to the period thereof becomes larger, the negative pressure for operating the diaphragm 11 becomes larger, and accordingly the opening of the throttle valve 2 is decreased. On the contrary, when the engine rotational speed Ne at engine idle is low, the ratio of the on-period tON of the pulse signal P becomes smaller, the operating negative pressure becomes smaller, and accordingly the opening of the throttle valve 2 is increased.

Thus, according to the invention it is not necessary to calculate the duty ratio of the control signal for on-off controlling the solenoid valve 20 and nor necessary to provide expensive control devices such as a pulse motor. The control system according to the invention has a simple structure but is capable of achieving proportional feedback control of the idling speed Ne in response to the engine rotational speed.

Further, when the electronic control unit 30 is supplied with a signal representing some external load on the engine from an electrical load detector 31, a power transmission detector 32, or a low water temperature detector 33, hereinafter referred to, it outputs a load detection signal eL to the solenoid 54 of the solenoid valve 50. The electrical load detector 31 detects on-off states of electric devices such as headlights, and outputs a load signal indicative of the detected on-off states. The power transmission detector 32 detects on-off states of an electromagnetic clutch, not shown, which connects and disconnects the compressor of the air-conditioner with and from the engine, or a signal indicating that the automatic transmission assumes a position other than a neutral position and a parking position, and then outputs a load signal indicative of the on-off states or position. The low water temperature detector 33 is actuated to output a signal when the cooling water temperature TW is lower than a predetermined value.

The solenoid valve 50 operates such that when the solenoid 54 is deenergized, the plunger 55 is biased by the force of the spring 57 toward the vacuum chamber 51 so that the valve body 56 closes the open end 70*a* of the passage 70 and opens the communication port 53*a*. On the other hand, when the solenoid 54 is energized, the plunger 25 is attracted by a magnetic force produced by the solenoid 54 and overcoming the urging force of the spring 57, to close the communication port 53*a* and open the open end 70*a* of the passage 70.

Similarly, the solenoid valve 60 is arranged such that when the solenoid 64 is deenergized, the plunger 65 is biased by the force of the spring 67 toward the vacuum chamber 61 so that the valve body 66 closes the open end 71*a* of the passage 71 and opens the communication port 63*a*, and when the solenoid 64 is energized, the plunger 65 is attracted by a magnetic force produced by the solenoid 64 and overcoming the urging force of the spring 67, to close the communication port 63*a* and open the open end 71*a* of the passage 71. The solenoid 64 is energized when the compressor of the air-conditioner is actuated.

When the engine is free from external loads, the solenoid valves 50 and 60 are deenergized and accordingly the vacuum-operated actuator 40 is inoperative wherein both the first and second vacuum chambers 48, 49 are in communication with the atmosphere, exerting no influence on the operation of the vacuum-operated actuator 10.

When the vacuum-operated actuator 40 is thus inoperative, proportional feedback control of the engine idling rotational speed is carried out in response to variations in the engine rotational speed so as to maintain the idling engine rotational speed Ne at a desired value.

When a power generator driven by the engine is burdened by such an external electrical load as headlights and small lights, the electrical load detector 31 detects the on-state of the external electrical load and outputs the load signal indicative thereof. When the electronic control unit 30 receives this signal from the load signal detector 31, it outputs the signal eL to thereby energize the solenoid 54 of the solenoid valve 50, whereupon the communication port 53*a* is closed and the open end 70*a* of the passage 70 is opened. As a result, the negative pressure in the intake pipe 1 is introduced into the first vacuum chamber 48 of the vacuum-operated actuator 40 via the passage 70, the chamber 51 of the solenoid valve 50, and the passage 72, whereupon the diaphragm 42 is displaced in the direction indicated by the arrow A in FIG. 1 until it is stopped by the movable stopper 44. As the diaphragm 42 is thus displaced, it pulls the rod 5 (via its extension 5') in the direction indicated by the arrow A, to thereby increase the opening of the throttle valve 2 from the opening assumed by the throttle valve 2 during engine idling operation before the external load is energized. This will be referred to as a first stage valve opening correction.

Similarly, the electronic control unit 30 also outputs the signal eL to actuate the solenoid valve 50 to thereby effect the first stage throttle valve opening correction, also when the electronic control unit 30 receives a signal from the power transmission detector 32 or from the low temperature detector 33, which is generated when the compressor of the air-conditioner is actuated, or when the automatic transmission assumes a position other than the neutral and parking positions, or when the engine cooling water temperature TW is lower than the predetermined value.

While the first stage valve opening correction is effected by generation of the signal eL in response to actuation of the external load(s) other than the compressor of the air-conditioner, if the compressor of the air-conditioner which forms a larger external load is actuated in addition, the solenoid 64 of the solenoid valve 60 is energized to close the communication port 63*a* and open the open end 71*a* of the passage 71. Then, negative pressure prevailing in the intake pipe 1 is introduced into the second vacuum chamber 49 of the vacuum-operated actuator 40 via the passage 71, the chamber 61 of the solenoid valve 60, and the passage 73. As a result, the diaphragm 43 together with the stopper 44 is displaced in the direction A, which compels the diaphragm 42 to be displaced by the same amount and in the same direction, since at this time negative pressure is introduced into the first vacuum chamber 48 as well. As a result, a second stage opening correction is effected whereby the opening of the throttle valve 2 is further increased from the opening assumed by the valve 2 on the occasion of the first stage correction. Consequently, it is possible to correct the throttle valve opening, and hence the engine rotational speed, through two stages in response to the magnitude of loads applied on the engine during engine idling, whereby stable idling engine operation is maintained.

Reference is now made to how the ECU 30 controls the rotational speed Ne of the engine at deceleration.

The ECU 30 calculates the engine rotational speed Ne by counting clock pulses generated within each time interval between two adjacent pulses of the ignition pulse signal Pg inputted thereto. When the engine rotational speed Ne drops across respective predetermined rotational speed values, e.g. 1250 rpm, 1000 rpm, and 850 rpm during decelerating operation of the engine, the ECU 30 deenergizes the solenoid 24 of the solenoid valve 20 with priority to the aforedescribed idling speed feedback control operation for a predetermined time period ΔT (hereinafter called "one shot time") by inhibiting the control pulse signal P from being supplied to the solenoid valve 20, to introduce the atmospheric air into the vacuum chamber 13 so as to open the throttle valve 2, to thereby avoid a sudden or abrupt drop in the engine rotational speed Ne.

Figures 4, 6:
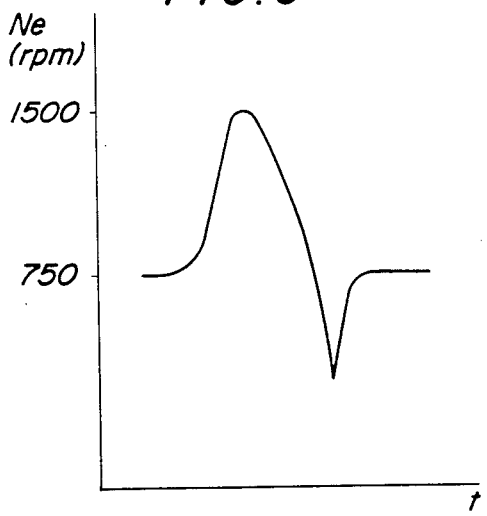
FIG. 4 is a view showing a table of the relationship between the rotational speed of the engine, rate of decrease in the engine rotational speed, and the time period for which the solenoid valve is deenergized.
FIG. 6 is a graph showing a characteristic of change of the rotational speed of the engine in a snap decelerating condition.

Further, the ECU 30 calculates a rate of decrease —ΔNe in the rotational speed Ne of the engine when the rotational speed Ne drops across each of the above-mentioned predetermined rotational speed values and sets the one shot time ΔT to a value corresponding to the calculated rate of decrease −ΔNe. In practice, the one shot time ΔT is set to different values in accordance with respective regions of the rate of decrease in the engine rotational speed. To be specific, the ECU 30 sets the one shot time ΔT to a larger value as the engine is operating at a higher speed or as the rate of decrease in the engine rotational speed is larger. An example of one shot time values ΔT is shown in the table of FIG. 4 with respect to the rate of decrease −ΔNe in the engine rotational speed and the engine rotational speed Ne.

Figure 5:
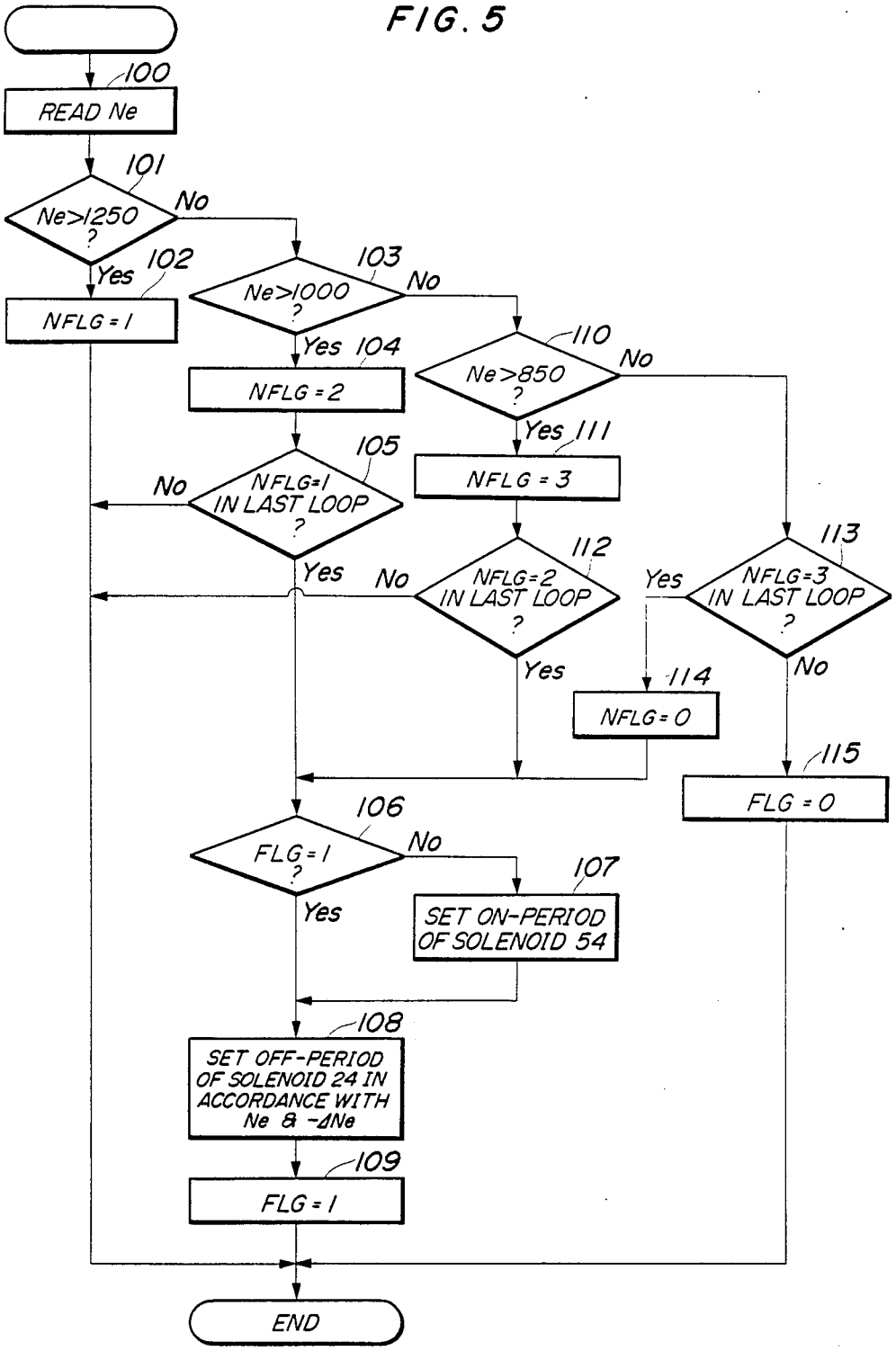
FIG. 5 is a flowchart showing a program routine for controlling the rotational speed of the engine in snap decelerating conditions.

A manner of controlling the idling speed of the engine during at snap deleceration will now be explained with reference to FIG. 3 to FIG. 5. The program of FIG. 5 is executed in synchronism with a predetermined timing signal whose pulses are generated at a time interval of 100 msec, for instance.

Figure 3:
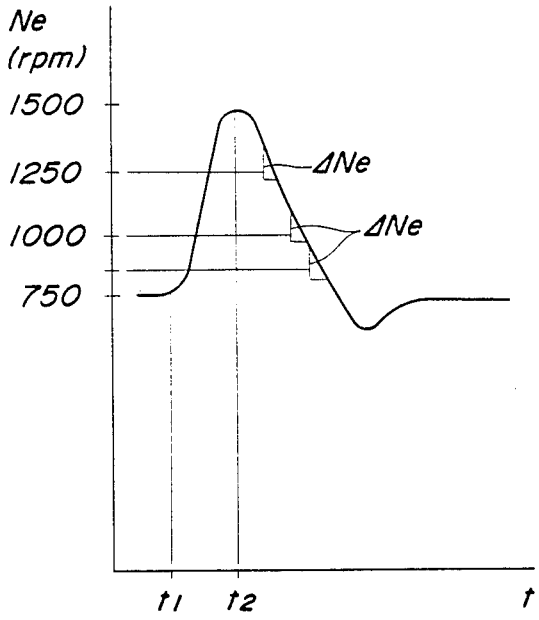
FIG. 3 is a graph showing a characteristic of the control of the engine rotational speed at snap deceleration of the engine.

Let it now assumed, for example, that as shown in FIG. 3, when the engine is operating in an idling region, e.g. at 750 rpm, the accelerator pedal is stepped on at a time t1 and suddenly released at a time t2 at which the engine rotational speed Ne has increased e.g. to 1500 rpm. The ECU 30, as described above, counts clock pulses generated between two adjacent pulses of the ignition pulse signal Pg, calculates the engine rotational speed Ne each time each pulse of the above-mentioned predetermined timing signal is generated, and temporarily store the calculated Ne value in a memory, not shown, at the step 100 in FIG. 5. Then, it is determined at the step 101 whether or not the stored value of the engine rotational speed Ne is higher than a predetermined value (e.g. 1250 rpm). If the answer to the question of the step 101 is affirmative or yes, a flag NFLG is set to 1 at the step 102, followed by termination of the program. The value 1 set in the flag NFLG indicates that the engine rotational speed Ne is in a rotational speed region above 1250 rpm.

If the answer at the step 101 is negative or no, it is determined at the step 103 whether or not the engine rotational speed Ne is higher than another predetermined value (e.g. 1000 rpm). If the answer to the question of the step 103 is affirmative or yes, the flag NFLG is set to 2 at the step 104 to indicate that the engine rotational speed Ne is in a region aboe 1000 rpm. Then, the program proceeds to the step 105 wherein it is determined whether or not the flag NFLG was set to 1 in the immediately preceding or last loop. If the answer to the question at the step 105 is negative or no, that is, if the engine rotational speed Ne has not dropped from the region aboe 1250 rpm, the program is terminated. On the other hand, if the answer to the question at the step 105 is affirmative or yes, that is, if the engine rotational speed has dropped from the region above 1250 rpm, the program proceeds to the step 106 wherein it is determined whether or not a flag FLG is set to 1 to 1 to indicate that the solenoid valve 20 has been energized to effect the rotational speed control at snap deceleration. The flag FLG is set at 0 at the step 115 at the time of initiation of the ECU 30 and each time the rotational speed control at snap deceleration is completed and set to 1 at the step 109 when the solenoid valve 20 is deenergized with priority to the idling speed feedback control, as will be described later. If the answer to the question at the step 106 is negative or no, the program proceeds to the step 107 wherein the solenoid 54 of the solenoid valve 50 is energized for a predetermined period of time if the rate of decrease $-\Delta Ne$ exceeds a predetermined value. To be specific, at the step 107, if the rate of decrease $-\Delta Ne$ exceeds the predetermined value e.g. 10 rpm, the ECU 30 energizes the solenoid 54 of the solenoid valve 50 for the predetermined period of time (e.g. 5 seconds) by the use of the table of FIG. 4, irrespective of whether or not the control is being effected by the signal eL, to thereby introduce negative pressure produced in the intake pipe 1 into the vacuum-operated chamber 48 of the vacuum-operated actuator 40. To be concrete, when the engine rotational speed Ne drops from the region above 1250 rpm across the predetermined value 1250 rpm with the flag FLG set at 0, the ECU 30 energizes the solenoid 54 for 5 seconds, if the rate of change $-\Delta Ne$ exceeds 10 rpm. Further, as will be described later, when the engine rotational speed drops from the region between the two predetermined values, 1250 rpm and 1000 rpm ($1250 > Ne > 1000$) across the predetermined value 1000 rpm with flag FLG set at 0, the ECU 30 energizes the solenoid 54 for 5 seconds, if the rate of change $-Ne$ exceeds 10 rpm. In the same manner as described above, when the engine rotational speed drops from the region between the two predetermined values 1000 rpm and 850 rpm ($1000 > Ne > 850$) across the predetermined value 850 rpm with flag FLG set at 0, the ECU energizes the solenoid 54 for 5 seconds, if the rate of decrease $-\Delta Ne$ exceeds 10 rpm. In this way, when the engine rotational speed Ne drops across one of the three predetermined values, i.e. 1250 rpm, 1000 rpm, and 850 rpm, the solenoid 54 is energized, only if the flag FLG has then been set at 0, taht is, it is energized only one time.

As described above, when the program proceeds to the step 107 through the steps 105 and 106, the ECU 30 energizes the solenoid 54 for the predetermined period of time to introduce negative pressure in the intake pipe 1 into the vacuum-operated chamber 48 of the vacuum-operated actuator 40, so that a first stage correction in the valve opening of the throttle valve 2 is effected, as described above, to thereby prevent the engine rotational speed Ne from suddenly decreasing.

Now, the program proceeds to the step 108 wherein the deenergization period (off-period) of the solenoid 24 i.e. the one shot time $\Delta T$ is set in accordance with the engine rotational speed Ne and the rate of decrease $-\Delta Ne$ in the engine rotational speed Ne from the table of FIG. 4, and the flag FLG is set to 1 the step 109 to indicate that the solenoid 24 has been deenergized, followed by termination of the program. The rate of decrease $-\Delta Ne$ is determined as a difference between an engine rotational speed value $Ne-1$ obtained at an immediately preceding pulse of the aforementioned timing pulse and a value Ne obtained at a present pulse of the same signal.

The ECU 30 inhibits the control pulse signal P [(c) of FIG. 2] from being outputted for the determined one shot time period $\Delta T$ (=300 msec). Then, the solenoid 24 is deenergized so that the atmospheric air is introduced into the vacuum chamber 13 of the vacuum-operated actuator 10 to open the throttle valve 2, whereby the engine rotational speed Ne slowly decreases without suddenly dropping. This valve opening control is executed with priority to the idling speed feedback control operation, hereinbefore described.

If the answer to the question at the step 103 is negative or no, that is, if the engine rotational speed Ne is below 1000 rpm, the program proceeds to the step 110 wherein a determination is made as to whether or not the engine rotational speed Ne is above 850 rpm. If the answer to the question of the step 110 is affirmative or yes, the flag NFLG is set to 3 at the step 111 to indicate that the engine rotational speed Ne is in a region above 850 rpm, followed by the program proceeding to the step 112. It is determined at the step 112 whether or not the flag NFLG was set at 2 in the immediately preceding loop, that is, if the engine rotational speed Ne has dropped from the region above 1000 rpm. If the answer to the question of the step 112 is affirmative or yes, that is, if the engine rotational speed Ne has dropped from the region above 1000 rpm, the program proceeds to the step 106 wherein it is determined whether or not the flag FLG value is 1 or not. In the present loop, the flag FLG has already been set to 1, as described above, so that the answer to the question at the step 106 is affirmative or yes. Then the program proceeds to the step 108. At the step 108, the one shot time or deenergization period $\Delta T$ of the solenoid 24 is set in accordance with the engine rotational speed Ne and the rate of decrease $-\Delta Ne$ in the engine rotational speed, followed by termination of the program. For example, according to the FIG. 4 table, if the rate of decrease $-\Delta Ne$ is in a region between 25 rpm and 33 rpm, the one shot time $\Delta T$ is set to 200 msec, when the engine rotational speed Ne is in a region between 1000 rpm and 850 rpm.

The ECU 30 inhibits the control pulse signal P from being outputted for the determined one shot time $\Delta T$ (=200 msec). Then, in the same manner as described above, the throttle valve 2 is opened so that the engine rotational speed Ne slowly decreases. On the other hand, if the answer at the step 112 is negative or no, the program is terminated without executing the snap decelerating control operation.

If the answer to the question of the step 110 is negative or no, the program proceeds to the step 113 wherein it is determined whether or not the flag NFLG was set to 3 in the immediately preceding loop. If the answer to the question of the step 113 is affirmative or yes, that is, if the engine rotational speed Ne has dropped from the region above 850 rpm, the flag NFLG is reset at the step 114, and then the program proceeds to the step 106 to determine whether or not the flag FLG value is 1 or not. When the engine rotational speed Ne drops from the region $Ne > 1250$ rpm or the region $1250 \text{ rpm} > Ne > 1000$ rpm, the flag FLG has already been set to 1. Otherwise, the flag FLG maintains a value of 0. Therefore, if the answer to the question at the step 106 is affirmative or yes, the program proceeds to the step 108 wherein the deenergization period $\Delta T$ of the solenoid 24 is set in accordance with the engine rotational speed Ne and the rate of decrease $-\Delta Ne$ in the engine rotational speed, followed by execution of the step 109 and termination of the program. For example, according to the FIG. 4 table, if the rate of decrease $-\Delta Ne$ is in a region between 25 rpm and 28 rpm, the one shot time $\Delta T$ is set to 30 msec, when the engine rotational speed Ne is in a region below 850 rpm. On the other hand, If the answer to the question of the step 106 is negative or no, the program proceeds to the step 107 wherein the solenoid 54 is energized for 5 seconds, that is, the opening of the throttle valve 2 is corrected. Then, the program proceeds to the step 108 to determine and set the energization period T of the solenoid 24, followed by termination of the program through the step 109.

The ECU 30 inhibits the control pulse signal P from being outputted for the determined one shot time T (=30 msec) to open the throttle valve 2, so that the engine rotational speed Ne slowly decreases. On the other hand, if the answer at the step 113 is negative or no, the program is terminated without executing the snap decelerating control operation.

As described above, when the engine rotational speed Ne drops across one of the predetermined values for the first time at snap deceleration, the solenoid 54 is only once energized for 5 seconds to correct the opening of the throttle valve 2. Further, when the engine rotational speed Ne drops across the respective predetermined rotational speed values, i.e. 1250 rpm, 1000 rpm, and 850 rpm, during snap decelerating operation, the throttle valve 2 is opened for the one shot time $\Delta T$ determined in accordance with the engine rotational speed Ne and the rate of decrease $-\Delta Ne$ in the engine rotational speed, wherein the engine rotational speed Ne to be controlled is divided into 3 regions in each of which mitigation of a drop in the engine rotational speed Ne is carried out. In this way, the rotational speed Ne of the engine at snap deceleration can be prevented from largely dropping below a desired idling speed, whereby the engine can stably operate.

Incidentally, when the engine rotational speed decreases from the region above 1250 rpm, the solenoid valve 20 is energized to open the throttle valve 2 each time the engine rotational speed Ne drops across each of the three predetermined values, i.e. 1250 rpm. 1000 rpm, and 850 rpm. However, if the solenoid valve 54 is also operated to open the throttle valve 2 three times in the same manner as the solenoid valve 20 does, it can cause hunting in the engine rotational speed. Therefore, the solenoid valve 50 is allowed to operate only one time, as stated above.

Further, a further advantage of the idling control system of the invention is that by virtue of the use of the vacuum-operated actuator using a diaphragm and adapted to open the throttle valve by the atmospheric pressure (a first control pressure), the throttle valve can be opened to a larger degree when the engine is operating at a high altitude than when the engine is operating at a low altitude, since the operating negative pressure acting upon the actuator becomes smaller with a decrease in the intake pipe vacuum (a second control pressure) at such a high altitude, enabling to increase the idling speed at a high altitude higher than that at a low altitude and to thereby stabilize the idling operation of the engine.

What is claimed is:

1. An idling speed control system for controlling idling rotational speed of an internal combustion engine having an intake passage and a throttle valve arranged therein, comprising:

vacuum-operated actuator means having a vacuum chamber, and a diaphragm defining said vacuum chamber chamber, and a diaphragm defining said vacuum chamber and operatively connected to said throttle valve for controlling opening and closing thereof in response to pressure in said vacuum chamber;

change-over control valve means operatively connected to said vacuum-operated actuator means for supplying said vacuum chamber, selectively, with a first control pressure or opening said throttle valve and a second control pressure for closing said throttle valve;

electronic control means operatively connected to said engine and said change-over control valve means, said electronic control means being adapted to effect control of the idling rotational speed of the engine by generating an on-off control pulse signal having a period corresponding to rotational speed of said engine, one of on-period and off-period of said on-off control pulse signal having a predetermined constant value, supplying said change-over control valve means with said on-off control pulse signal, in response to which said change-over control valve means supplies said vacuum chamber of said vacuum-operated actuator means, selectively, with said first control pressure and said second control pressure, said electronic control means being adapted to determine the rotational speed of said engine and a rate of decrease in the rotational speed of said engine, and halt said control for a predetermined period of time when the determined rotational speed of said engine falls within a predetermined range and at the same time the determined rate of decrease in the engine rotational speed falls within a predetermined range;

valve opening-correcting means operatively connected to said throttle valve and being responsive to at least one predetermined external load applied on said engine for correcting to a larger opening the opening of said throttle valve which is determined by said change-over control valve means in response to said on-off control pulse signal; and said electronic control means being adapted to actuate said valve opening-correcting means to increase the opening of said throttle valve which is determined by said change-over control valve means in response to said on-off control pulse signal, when said electronic control unit halts said control of the idling rotational speed of said engine for said predetermined period of time.

2. An idling speed control system as claimed in claim 1, wherein said electronic control means is adapted to actuate said valve opening-correcting means to increase the opening of said throttle valve which is determined by said change-over control valve means in response to said on-off control pulse signal for a predetermined constant perid of time.

3. An idling speed control system as claimed in any of claims 1–2, wherein said electronic control means is adapted to execute said halting of said control when the rotational speed of said engine has dropped across each of a plurality of predetermined values, and at the same time the rate of decrease in the engine rotational speed falls within a predetermined range corresponding to the each of said plurality of predetermined values across which the engine rotational speed has dropped, and to actuate said valve opening-correcting means to increase the opening of said throttle valve which is determined by said change-over control valve means in response to said on-off control pulse signal only when the engine rotational speed has dropped across predetermined one of said plurality of predetermined values.

* * * * *

UNITED STATES PATENT AND TRADEMARK OFFICE

CERTIFICATE OF CORRECTION

PATENT NO. : 4,693,220

DATED : September 15, 1987

INVENTOR(S) : Hiroshi Hasebe, Masahiko Asakura, Michio Sakaino and Yukio Miyashita It is certified that error appears in the above-identified patent and that said Letters Patent is hereby corrected as shown below:

Column 13, line 68: delete "chamber, and a diaphragm defining said" after "chamber";

Column 14, line 1: delete "vacuum chamber" before "and";

Column 14, line 8: change "or" to "for".

Signed and Sealed this

Twenty-sixth Day of April, 1988

*Attest:*

*Attesting Officer*

DONALD J. QUIGG

*Commissioner of Patents and Trademarks*